US009038673B2

(12) United States Patent
Roy et al.

(10) Patent No.: US 9,038,673 B2
(45) Date of Patent: May 26, 2015

(54) DEVICE FOR MAKING WOVEN ARTICLE

(71) Applicant: Wooky Entertainment, Inc., Montreal (CA)

(72) Inventors: Dominique Roy, St-Lazare (CA); Guillaume Guyader, Verdun (CA)

(73) Assignee: Wooky Entertainment Inc., Montreal, Quebec (CA)

( * ) Notice: Subject to any disclaimer, the term of this patent is extended or adjusted under 35 U.S.C. 154(b) by 0 days.

(21) Appl. No.: 14/181,972

(22) Filed: Feb. 17, 2014

(65) Prior Publication Data

US 2015/0034204 A1 Feb. 5, 2015

Related U.S. Application Data

(60) Provisional application No. 61/860,374, filed on Jul. 31, 2013.

(51) Int. Cl.
*D03D 29/00* (2006.01)
*D03D 41/00* (2006.01)

(52) U.S. Cl.
CPC ..... *D03D 29/00* (2013.01)

(58) Field of Classification Search
CPC ..... D03D 29/00; D04G 5/00; D04B 33/00; D04D 1/04
USPC ..... 139/29, 33, 33.5, 34
See application file for complete search history.

(56) References Cited

U.S. PATENT DOCUMENTS 758,376 A * 4/1904 Mees ..... 28/151
1,203,781 A * 11/1916 Ratycia ..... 28/149
2,043,082 A * 6/1936 Wallach ..... 28/151
2,072,668 A * 3/1937 Eltgroth ..... 66/4
2,382,048 A * 8/1945 Fox et al. ..... 139/34
2,395,981 A * 3/1946 Walker ..... 289/17
2,601,222 A * 6/1952 Wehrli ..... 28/151
2,802,255 A * 8/1957 Wallach ..... 28/151
D204,442 S * 4/1966 Brawley, Jr. ..... D15/66
3,800,372 A * 4/1974 Daoust ..... 28/152
4,044,446 A * 8/1977 Segerman ..... 29/241
4,045,061 A * 8/1977 Fierro ..... 289/16.5
4,074,726 A * 2/1978 Harris ..... 139/29
4,131,138 A * 12/1978 Boisvert ..... 139/29
5,413,150 A * 5/1995 Townsend ..... 139/34
6,719,013 B1 * 4/2004 D'Estais ..... 139/29
7,147,008 B2 * 12/2006 Sayler ..... 139/29
7,677,273 B2 * 3/2010 Skaflestad ..... 139/29
D619,150 S * 7/2010 Crorey ..... D15/78
7,762,284 B2 * 7/2010 Ricks ..... 139/29

(Continued)

*Primary Examiner* — Bobby Muromoto, Jr.
(74) *Attorney, Agent, or Firm* — Harness, Dickey & Pierce, PLC

(57) ABSTRACT

A device for making a woven article from a plurality of strings includes a base, a post, first and second engagement devices and a stabilization device. The base has a plurality of slots formed therein. The first engagement device engages first ends of the strings and is fixedly attached to the base and fixed relative to the slots, thereby fixing the first ends relative to the base. The second engagement device is fixedly attached to the base and includes a plurality of slits each configured to secure a corresponding one of the strings. The slots formed in the base are disposed between and spaced apart from the first and second engagement devices. The stabilization device is removably engageable with a selected one of the slots and is configured to engage a selected portion of the strings between the first and second engagement devices to restrict twisting of the strings.

20 Claims, 6 Drawing Sheets

(56) References Cited

U.S. PATENT DOCUMENTS

| | | | | |
|---|---|---|---|---|
| 7,946,631 | B2 * | 5/2011 | Crorey | 289/2 |
| 8,066,035 | B1 * | 11/2011 | Stevens | 139/29 |
| D656,524 | S * | 3/2012 | Karwowicz | D15/78 |
| 8,132,596 | B2 * | 3/2012 | Weidler et al. | 139/29 |
| D667,468 | S * | 9/2012 | Crorey | D15/78 |
| D676,879 | S * | 2/2013 | Hudgins | D15/66 |
| 8,371,624 | B2 * | 2/2013 | Karwowicz et al. | 289/17 |
| 8,561,650 | B1 * | 10/2013 | Wijerama et al. | 139/29 |
| D700,220 | S * | 2/2014 | Crorey | D15/78 |
| 8,746,753 | B2 * | 6/2014 | Crorey | 289/13 |
| D717,347 | S * | 11/2014 | Hatcher | D15/66 |

* cited by examiner

DEVICE FOR MAKING WOVEN ARTICLE

CROSS-REFERENCE TO RELATED APPLICATIONS

This application claims the benefit of U.S. Provisional Application No. 61/860,374, filed on Jul. 31, 2013. The entire disclosure of the above application is incorporated herein by reference.

FIELD

The present disclosure relates to a device for making a woven article.

BACKGROUND

This section provides background information related to the present disclosure and is not necessarily prior art.

Crafting woven articles such as friendship bracelets, necklaces or belts, for example, can be a fun and enjoyable hobby or occupation. Such articles can be made by weaving and tying thread and/or yarn of one or more colors in a desired pattern. While devices have been provided in the past that hold both ends of the strings to facilitate weaving and/or tying of the article, a stabilization device that engages a portion of the thread and/or yarn between opposing ends of the strings should improve the process of crafting such articles.

SUMMARY

This section provides a general summary of the disclosure, and is not a comprehensive disclosure of its full scope or all of its features.

The present disclosure provides a device for making a woven article from a plurality of strings includes a base, first and second engagement devices and an intermediate stabilization device. The base has a plurality of slots formed therein. The first engagement device secures first ends of the strings and is fixedly attached to the base and fixed relative to the slots, thereby fixing the first ends relative to the base. The second engagement device is fixedly attached to the base and includes a plurality of slits each configured to secure a corresponding one of the strings. The slots formed in the base are disposed between and spaced apart from the first and second engagement devices. In some embodiments, the stabilization device may be mounted in slots formed in the decorative, somewhat convex surface of the base. In some embodiments, the slots may be located within one or more recesses provided along the convex decorative surface of the base. In some embodiments, the stabilization device includes a protrusion removably engageable with a selected one of the slots. The stabilization device is configured to engage a selected portion of the strings occurring between the first and second engagement devices to restrict twisting of the strings.

In another form, the present disclosure provides a device for making a woven article from a plurality of strings. The device may include a base, first and second engagement devices and an intermediate stabilization device. The first engagement device secures first ends of the plurality of strings relative to the base. The second engagement device is fixedly attached to the base and includes a plurality of slits each configured to secure a corresponding one of the plurality of strings. The stabilization device engages a selected portion of the plurality of strings between the first and second engagement devices to restrict twisting of the strings. The stabilization device is mounted to the base and selectively movable relative to the first and second engagement devices among a plurality of positions between the first and second engagement devices.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
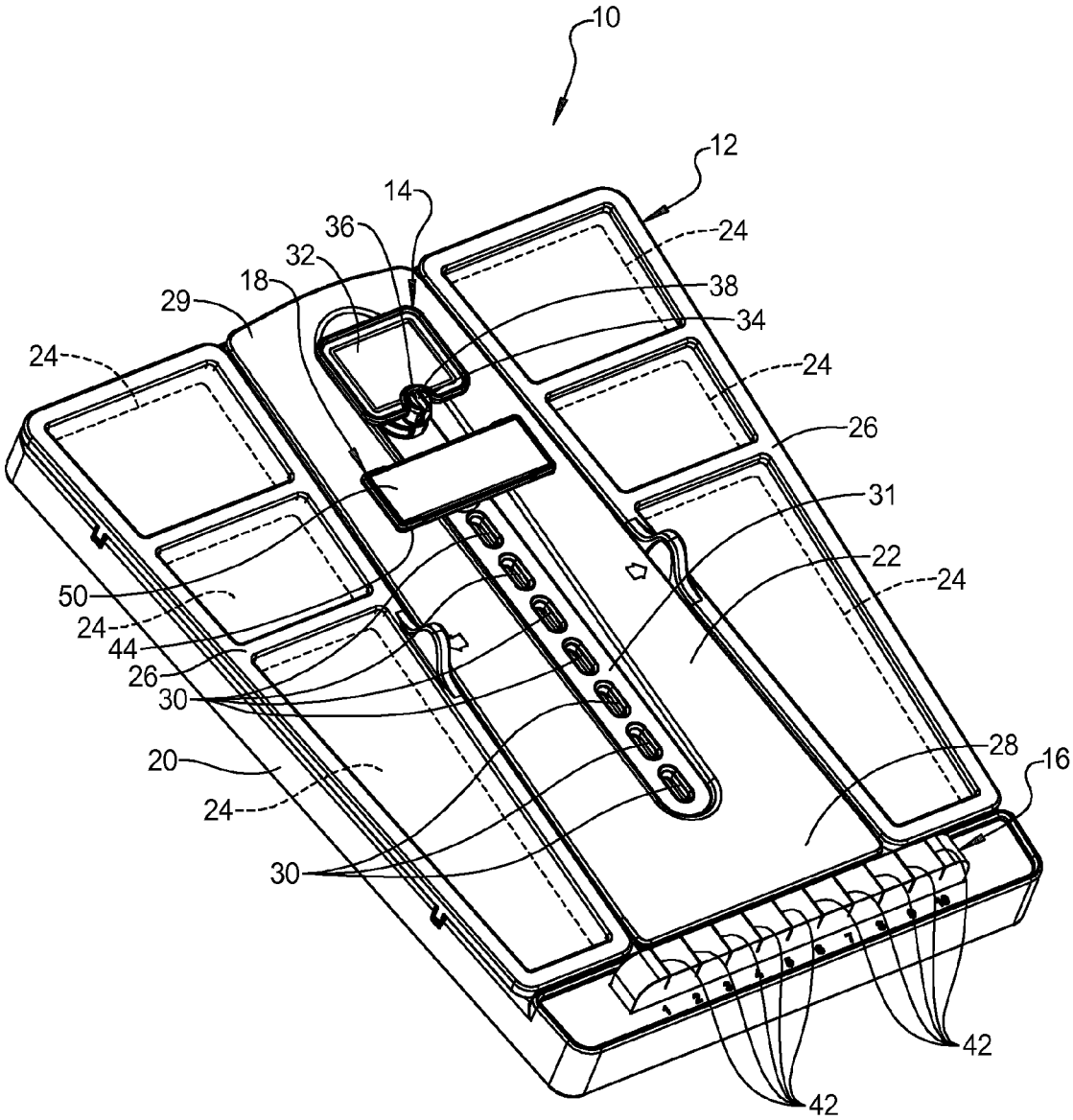
FIG. 1 is a perspective view of a device for making a woven article according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

With reference to FIGS. 1-7, a device 10 is provided that includes a base 12, a first engagement device 14, a second engagement device 16 and an intermediate stabilization device 18. The device 10 may be used to make woven articles, such as friendship bracelets and/or necklaces, for example, from a plurality of strings 19. The term "string," as used herein, refers to thread, yarn, cord, line or twine, for example or any other material that can be used for weaving, twisting, tying and/or sewing, for example.

The base 12 may include a foundation 20 and a plate 22. The foundation 20 may include one or more compartments 24 (FIG. 1) formed therein and one or more doors 26 hingedly coupled to the foundation 20 to selectively restrict and allow access to the compartments 24. A user may store string, beads, other accessories and/or tools in the compartments 24.

Figure 3:
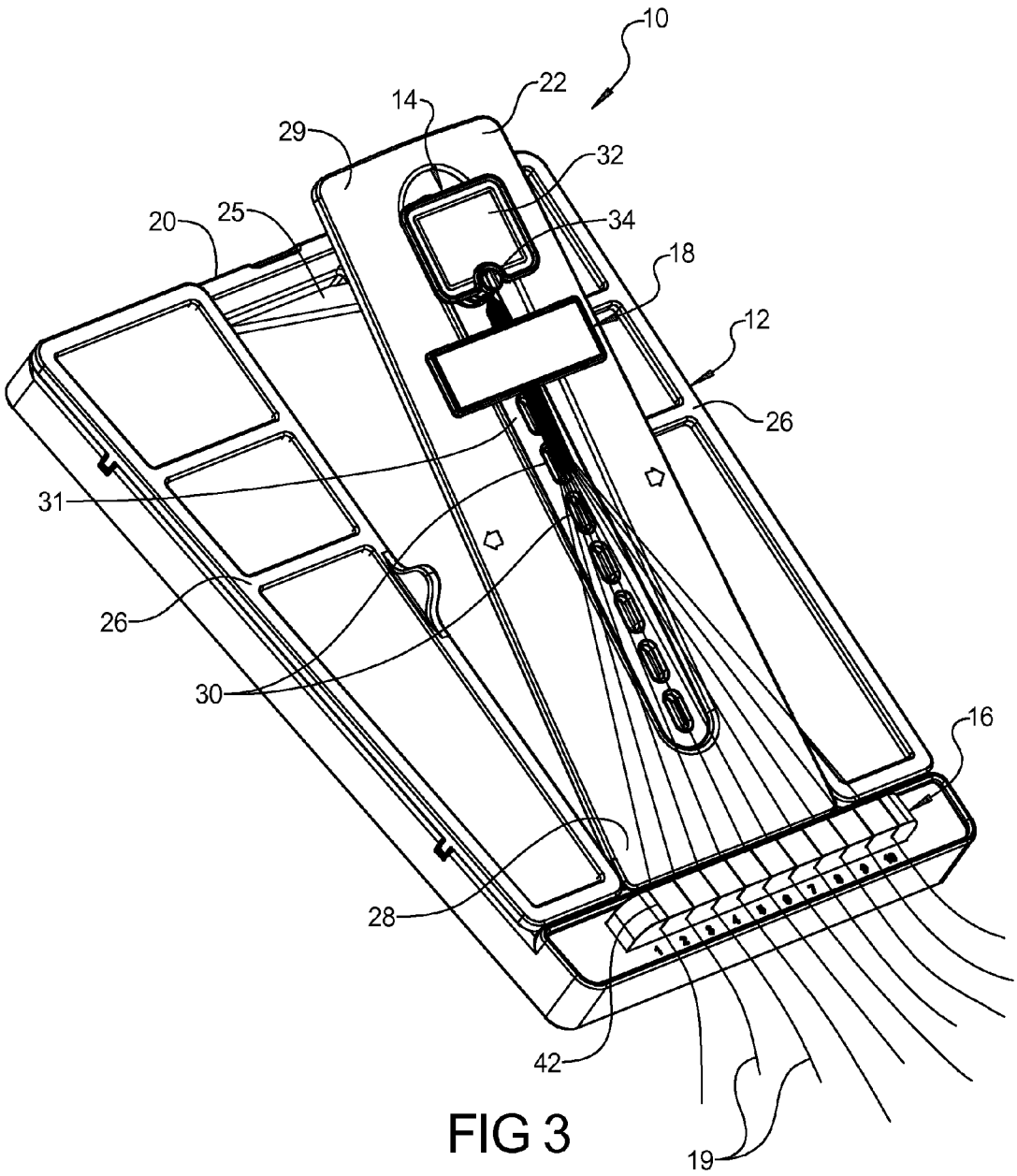
FIG. 3 is another perspective view of the device with a portion of a base of the device in a raised position.
Figure 4:
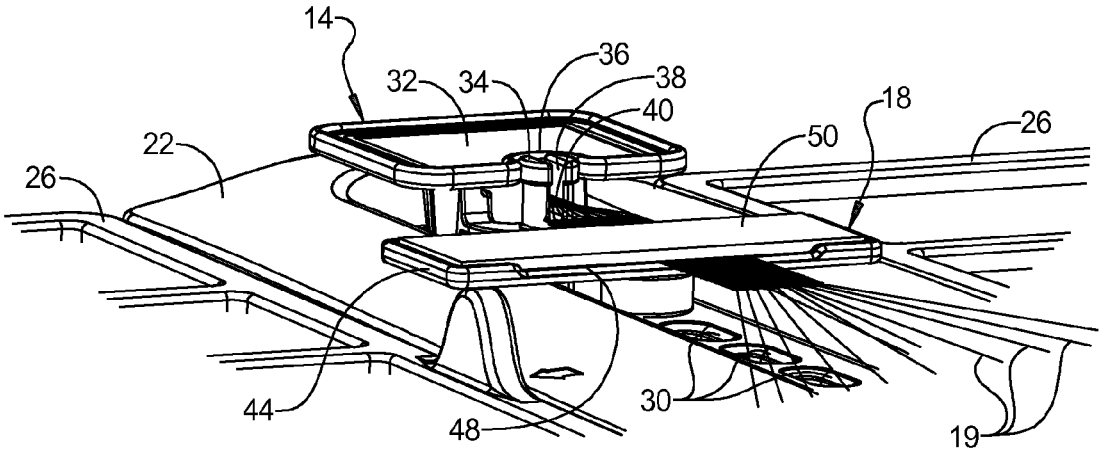
FIG. 4 is a partial perspective view of the device.
Figure 5:
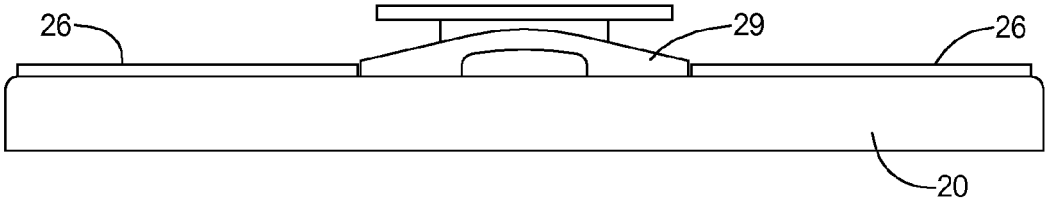
FIG. 5 is an end view of the device.
Figure 6:
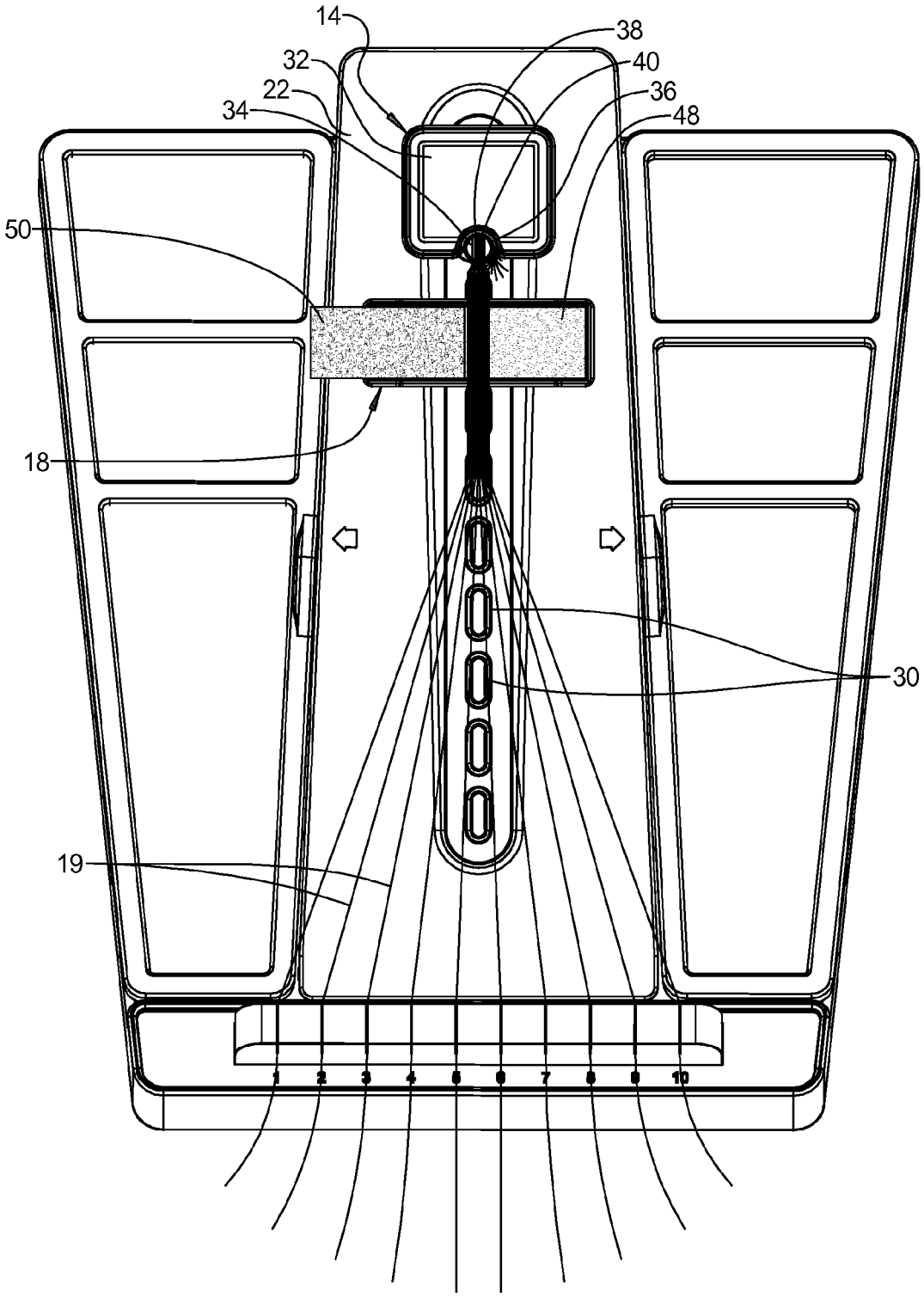
FIG. 6 is another partial perspective view of the device.
Figure 7:
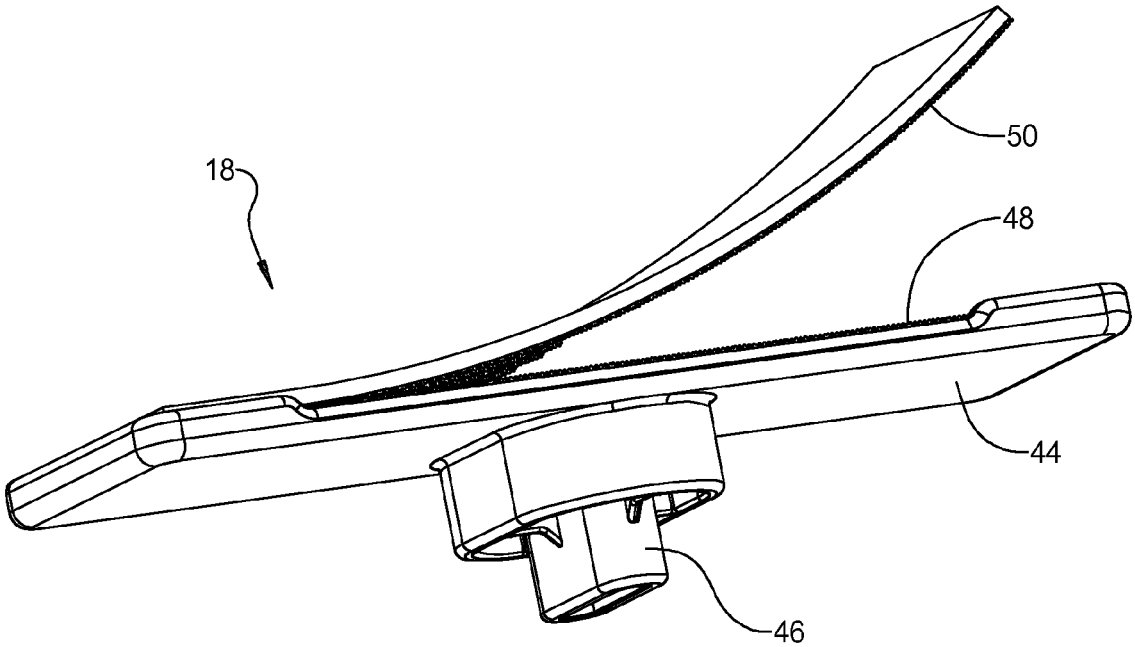
FIG. 7 is a perspective view of a stabilization device of the device.

A first end 28 of the plate 22 may be hingedly coupled to the foundation 20 to allow the plate to rotate relative to the foundation from a first position (shown in FIG. 1) to an elevated second position (shown in FIG. 3). A prop bar 25 (FIG. 3) may be provided between the plate 22 and the foundation 20 to selectively maintain the plate 22 in the second position. The plate 22 includes a plurality of slots 30 formed therein and arranged in a linear pattern extending between the first end 28 and a second end 29 of the plate 22. The plate 22 may include a convex curvature (as shown in FIGS. 4 and 5), particularly along the second end 29 so that the surface slopes downwardly and away from the first engagement device 14. By providing the convex shape, the plate 22 can be more readily grasped along the second end 29 to lift the plate 22 to the elevated second position (shown in FIG. 3). Further, the sloping provides for better clearance for the user's hands when the plate 22 is in the more horizontal first position shown in FIG. 1. In some embodiments, the slots 30 may be formed in an elongated recessed portion 31 of the plate 22. As will be subsequently described, the intermediate stabilization device 18 is removably engageable with any selected one of the slots 30 so that the intermediate stabilization device 18 can be selectively placed at any one of a plurality of discrete positions defined by the slots 30.

Figure 2:
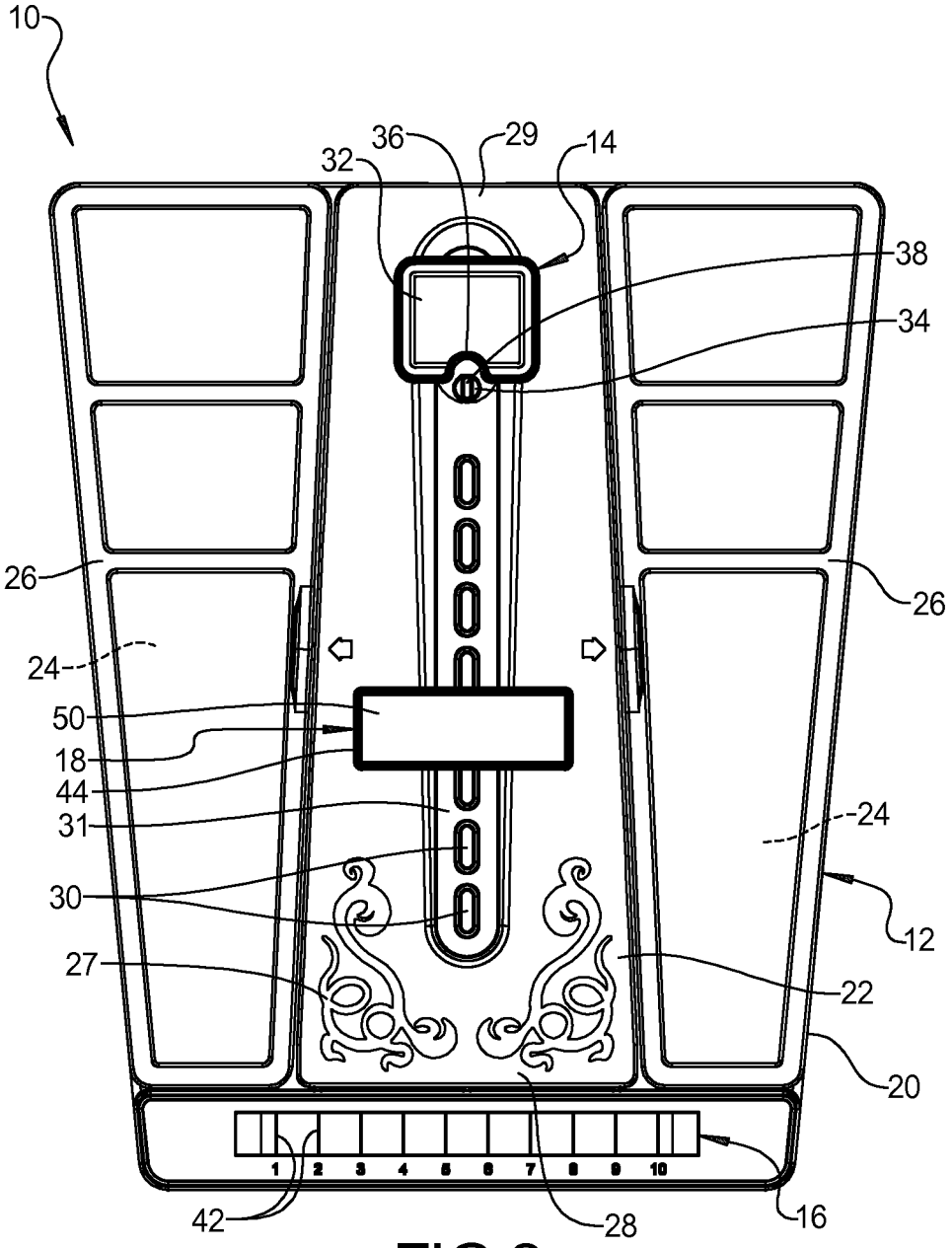
FIG. 2 is a plan view of the device.

As shown in FIGS. 3-6, the first engagement device 14 secures first ends 40 of the strings 19 and includes a locking member 32 and a post 34. The locking member 32 is fixedly attached to the plate 22 and may include a notch 36. The post 34 may include a slot 38 and may be coupled to the locking member 32 for movement relative to the locking member 32 between a locked position (FIG. 1) and an unlocked position (FIG. 2). When the post 34 is in the unlocked position, the first ends 40 of the strings 19 can be looped around the post 34 and through the slot 38. Then, the post 34 is moved to the locked position to secure the first ends 40 of the strings 19. In the locked position, the post 34 is nested in the notch 36 of the locking member 32. With the post 34 received in the notch 36, the first ends 40 of the strings 19 are restricted or prevented from disengaging the post 34. In some embodiments, friction or interference between the post 34 and the locking member 32 may retain the post 34 in the locked position to prevent unintentional movement of the post 34 into the unlocked position. In some embodiments, the post 34 may be spring-biased toward the locked position to prevent unintentional movement of the post 34 into the unlocked position.

The second engagement device 16 may be an elongated foam or rubber member fixedly attached to the foundation 20 and extending in a direction that is substantially parallel to the direction in which the linear pattern of slots 30 extends. The second engagement device 16 may include a plurality of slits 42 formed therein. The slits 42 may be parallel to each other and parallel to the linear pattern of slots 30. As shown in FIG. 3, each of the slits 42 may be removably engaged by a corresponding one of the strings 19. The first and second engagement devices 14, 16 cooperate to hold the strings 19 in a generally taught condition, as shown in FIG. 3.

The intermediate stabilization device 18 may include a body 44 and a protrusion 46 (FIG. 7) extending from the body 44. The protrusion 46 is removably engageable with any selected one of the slots 30 in the plate 22. The protrusion 46 is able to snap into any one of the slots 30 in order to removably fix the intermediate stabilization device 18 in a desired one of a plurality of discrete positions between the first and second engagement devices 14, 16. In this manner, while the protrusion 46 is snapped into one of the slots 30, the intermediate stabilization device 18 is fixed in that position until the user snaps the intermediate stabilization device 18 free from that slot 30.

The body 44 may include a first strip 48 and a second strip 50 removably engaging the first strip 48. One of the first and second strips 48, 50 may include a plurality of hooks and the other of the first and second strips 48, 50 may include a plurality of loops. In this manner, the first and second strips 48, 50 cooperate to form a hook-and-loop fastener (e.g., Velcro®). The first and second strips 48, 50 engage an intermediate portion (e.g., a woven portion) of the strings 19 between opposing ends of the strings 19. As shown in FIG. 3, the intermediate portion of the strings 19 is sandwiched between the first and second strips 48, 50. In this manner, the intermediate stabilization device 18 restricts or prevents the strings 19 from being twisted while the user weaves the strings 19. It will be appreciated that the intermediate stabilization device 18 may employ other suitable means for engaging the woven article, such as a spring-biased clip or clasp or a magnetic clip or clasp, for example. As weaving of the woven article progresses, the user may move the intermediate stabilization device 18 among the slots 30 so that the intermediate stabilization device 18 engages the woven article generally proximate to the unwoven individual strings 19 while the first and second engagement devices 14, 16 remain fixed.

With continued reference to FIGS. 1-7, a method of using the device 10 will be described. First, with the first engagement device 14 in the unlocked configuration (e.g., with the post 34 in the unlocked position), the ends 40 of the strings 19 are attached to the first engagement device 14 by looping and and/or tying the ends 40 around the post 34. Then, the user may move the post 34 to the locked position to fixedly secure the ends 40 to the first engagement device 14, thereby fixing the ends 40 relative to the plate 22. Next, portions of each string 19 distal from the ends 40 may be received in a corresponding slit 42 in the second engagement device 16 so that the strings 19 are held in a taught condition between the first and second engagement devices 14, 16. Before or after placing the strings 19 in the slits 42, the user may tilt the plate 22 relative to the foundation 20 and secure the plate 22 in the tilted position using the prop bar 25, as described above.

With the first engagement device 14 fixed in place and the strings 19 in the taught condition, the user may begin weaving the strings 19 in a desired pattern to form the woven article. As shown in FIG. 3, the user can stabilize the woven portion of the woven article with the intermediate stabilization device 18 by sandwiching the woven portion between the strips 48, 50. As the user continues to weave, more and more of the length of the strings 19 between the first and second engagement devices 14, 16 will be woven while the distance between the first and second engagement devices 14, 16 remains constant. As desired, the user may move the intermediate stabilization device 18 from one slot 30 to the next toward the second engagement device 16 to stabilize the strings 19 between the first and second engagement devices 14, 16 as desired and restrict or prevent unwanted twisting of the strings 19.

When the user has finished weaving the strings 19, the user may remove the strings 19 from the slits 42 in the second engagement device 16 and tie the strings 19 in a knot to prevent the strings 19 from unweaving. Any unwoven portion of the strings 19 can also be trimmed off using scissors, for example. The ends 40 of the strings 19 can be removed from the first engagement device 14 by moving the post 34 into the unlocked position and sliding the ends 40 off of the post 34.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A device for making a woven article from a plurality of strings, the device comprising:

a base having a plurality of slots formed therein;

a first engagement device for fixedly securing first ends of the plurality of strings, the first engagement device is attached to the base and fixed relative to the slots, thereby fixing the first ends relative to the base;

a second engagement device fixedly attached to the base and including a plurality of slits each configured to secure a corresponding one of the plurality of strings, wherein the slots formed in the base are disposed between and spaced apart from the first and second engagement devices, the slots in the base are arranged in a first linear pattern extending perpendicular to a second linear pattern in which the slits of the second engagement device are arranged; and a stabilization device including a protrusion removably attachable with a selected one of the slots while the stabilization device engages a selected portion of the plurality of strings between the first and second engagement devices to restrict twisting of the strings.

2. The device of claim 1, wherein base includes a foundation and a plate, the second engagement device being fixedly attached to the foundation, the slots are formed in the plate and the first engagement device is fixedly attached to the plate.

3. The device of claim 2, wherein the plate is hingedly coupled to the foundation to allow the plate to rotate relative to the foundation.

4. The device of claim 3, wherein the plate includes a convex surface that slopes downward away from the first engagement device.

5. The device of claim 1, wherein the base includes a storage compartment.

6. The device of claim 5, wherein the base includes a door that is movable relative to the first and second engagement devices between a first position restricting access to the storage compartment and a second position allowing access to the storage compartment.

7. The device of claim 1, wherein the protrusion of the stabilization device is configured to engage the slots by a snap fit.

8. The device of claim 1, wherein the stabilization device includes a first strip including a plurality of hooks and a second strip including a plurality of loops adapted to removably engage the hooks with the selected portion of the plurality of strings between the first and second strips.

9. The device of claim 1, wherein the second engagement device is a linear member.

10. A device for making a woven article from a plurality of strings, the device comprising:

a base;

a first engagement device fixed to the base for securing first ends of the plurality of strings relative to the base;

a second engagement device fixedly attached to the base and including a plurality of slits each configured to secure a corresponding one of the plurality of strings; and a stabilization device configured to engage a selected portion of the plurality of strings between the first and second engagement devices to restrict twisting of the strings, the stabilization device being mounted to the base and selectively movable relative to the first and second engagement devices among a plurality of positions between the first and second engagement devices, wherein the base includes a foundation and a plate, the second engagement device being fixedly attached to the foundation, the first engagement device is fixedly attached to the plate, the plate being hingedly coupled to the foundation to allow the plate to rotate relative to the foundation, the stabilization device attachable to the plate at one of the plurality of positions while simultaneously engaging the selected portion of the plurality of strings between the first and second engagement devices.

11. The device of claim 10, wherein the stabilization device is mounted to a convex surface of the base.

12. The device of claim 10, wherein the base includes a plurality of slots formed therein and arranged in a linear pattern.

13. The device of claim 12, wherein the stabilization device includes a protrusion that is removably engageable with a selected one of the slots.

14. The device of claim 13, wherein the protrusion of the stabilization device is configured to engage the slots by a snap fit.

15. The device of claim 13, wherein the second engagement device is a linear member extending perpendicular to the linear pattern of slots.

16. The device of claim 10, wherein the plate includes a convex surface that slopes downward away from the first engagement device.

17. The device of claim 10, wherein the base includes a storage compartment.

18. The device of claim 17, wherein the base includes a door that is movable relative to the first and second engagement devices between a first position restricting access to the storage compartment and a second position allowing access to the storage compartment.

19. The device of claim 10, wherein the stabilization device includes a first strip including a plurality of hooks and a second strip including a plurality of loops adapted to removably engage the hooks with the selected portion of the plurality of strings between the first and second strips.

20. The device of claim 13, wherein the linear pattern in which the slots are arranged extends perpendicular to another linear pattern in which the slits of the second engagement device are arranged.

* * * * *